US012583032B2

(12) United States Patent
Zheng et al.

(10) Patent No.: US 12,583,032 B2
(45) Date of Patent: Mar. 24, 2026

(54) METHOD FOR PREPARING A LOW-TEMPERATURE SINTERING SILVER PASTE

(71) Applicant: GM GLOBAL TECHNOLOGY OPERATIONS LLC, Detroit, MI (US)

(72) Inventors: Changcheng Zheng, Shenqui (CN); Ming Liu, Shanghai (CN); Congjie Wang, Shanghai (CN); Dekui Mu, Quanzhou (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 329 days.

(21) Appl. No.: 18/319,189

(22) Filed: May 17, 2023

(65) Prior Publication Data

US 2024/0286192 A1 Aug. 29, 2024

(30) Foreign Application Priority Data

Feb. 23, 2023 (CN) ..... 202310187370.X

(51) Int. Cl.

| | |
|---|---|
| ***B22F 7/06*** | (2006.01) |
| ***B22F 1/052*** | (2022.01) |
| ***B22F 1/054*** | (2022.01) |
| ***B22F 1/103*** | (2022.01) |
| ***B22F 7/00*** | (2006.01) |

(52) U.S. Cl.

CPC ..... *B22F 7/064* (2013.01); *B22F 1/052* (2022.01); *B22F 1/056* (2022.01); *B22F 1/103* (2022.01); *B22F 7/008* (2013.01); *B22F 2301/255* (2013.01); *B22F 2302/45* (2013.01); *B22F 2304/058* (2013.01); *B22F 2998/10* (2013.01); *B22F 2999/00* (2013.01)

(58) Field of Classification Search

None

See application file for complete search history.

(56) References Cited

U.S. PATENT DOCUMENTS

| | | | |
|---|---|---|---|
| 4,810,672 | A | 3/1989 | Schwarzbauer |
| 2014/0113109 | A1 | 4/2014 | Kurita et al. |

FOREIGN PATENT DOCUMENTS

| | | | |
|---|---|---|---|
| JP | 202198875 | A | 7/2021 |

OTHER PUBLICATIONS

German Office Action for German Application No. 10 2023 108 211.6 dated Oct. 18, 2023.

*Primary Examiner* — Anthony M Liang

(57) ABSTRACT

A method for preparing a silver paste includes creating a mixture of succinic acid, 1-butoxy-2-propanol, terpineol, ethanol, and ethylene glycol; ultrasonically mixing the mixture for a first predetermined period; adding silver particles; and mechanically stirring the mixture for a second predetermined period to create a silver paste.

7 Claims, 2 Drawing Sheets

METHOD FOR PREPARING A LOW-TEMPERATURE SINTERING SILVER PASTE

CROSS-REFERENCE TO RELATED APPLICATIONS

This application claims the benefit of Chinese Patent Application No. 202310187370.X, filed on Feb. 23, 2023. The entire disclosure of the application referenced above is incorporated herein by reference.

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to silver paste, and more particularly to a method for preparing a low-temperature sintering silver paste.

Sintered silver joints have emerged as a promising candidate for high temperature bonding approaches for die attachment and other automotive applications. Sintered silver joints may be used to replace high-lead and gold-based solders due to excellent thermal conductivity, good electrical conductivity, and high melting temperature (961° C. for bulk silver as compared to about 200° C. for tin).

However, there are still some challenges preventing wider use of sintered silver joints. The sintering process poses a risk of damage to integrated circuits. Sintered joints have relatively low shear stress as compared to soldered joints. In addition, nano-silver particles are relatively expensive.

SUMMARY

A method for preparing a silver paste includes creating a mixture of succinic acid, 1-butoxy-2-propanol, terpineol, ethanol, and ethylene glycol; ultrasonically mixing the mixture for a first predetermined period; adding silver particles; and mechanically stirring the mixture for a second predetermined period to create a silver paste.

In other features, the first predetermined period is in a range from 5 to 15 minutes. The second predetermined period is in a range from 5 to 15 minutes. Ultrasonically mixing the mixture is performed at room temperature.

In other features, the succinic acid is in a range from 0.05% to 0.2% wt., the 1-butoxy-2-propanol is in a range from 2% to 5% wt., the terpineol is in a range from 3% to 8% wt., the ethanol is in a range from 3% to 8% wt.; the ethylene glycol is in a range from 8 to 12% wt.; and the silver particles are in a range from 75 to 90% wt.

In other features, the silver particles include first particles having a size in a range from 50 nm to 150 nm, and second particles having a size in a range from 300 nm to 600 nm. A mass ratio of the first particles to the second particles is in between 5:1 and 1:3.

A method for bonding first and second components using silver paste includes applying a silver paste to a first surface of a first component. The silver paste comprises succinic acid in a range from 0.05% to 0.2% wt.; 1-butoxy-2-propanol in a range from 2% to 5% wt.; terpineol in a range from 3% to 8% wt.; ethanol in a range from 3% to 8% wt.; ethylene glycol in a range from 8 to 12% wt.; and silver particles in a range from 75% to 90% wt. The method includes baking the first component and the silver paste for a first predetermined period; arranging a second component on the silver paste located on the first component; and pressure sintering the first component, the second component, and the silver paste.

In other features, the method includes preparing the silver paste by creating a mixture of the succinic acid, the 1-butoxy-2-propanol, the terpineol, the ethanol, and the ethylene glycol; ultrasonically mixing the mixture for a first predetermined period; adding the silver particles; and mechanically stirring the mixture for a second predetermined period to create the silver paste.

In other features, the pressure sintering is performed at a pressure in a range from 1 to 10 MPa and a temperature in a range from 250° C. to 280° C. for a period in a range from 3 to 10 minutes.

In other features, the first predetermined period is in a range from 5 to 40 minutes, and the baking is performed at a temperature in a range from 50° C. to 90° C. The method includes applying the silver paste to the first component includes screen printing the silver paste on the first component. The first predetermined period is in a range from 5 to 15 minutes. The second predetermined period is in a range from 5 to 15 minutes. Ultrasonically mixing the mixture is performed at room temperature. The silver particles include first particles having a size in a range from 50 nm to 150 nm and second particles having a size in a range from 300 nm to 600 nm. A mass ratio of the first particles to the second particles is in a range from 5:1 to 1:3.

A silver paste comprises succinic acid in a range from 0.05% to 0.2% wt.; 1-butoxy-2-propanol in a range from 2% to 5% wt.; terpineol in a range from 3% to 8% wt.; ethanol in a range from 3% to 8% wt.; ethylene glycol in a range from 8 to 12% wt.; and silver particles in a range from 75% to 90% wt.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

The present disclosure relates to a low-temperature, sinterable silver paste and a method for preparing the silver paste. The method involves ultrasonic mixing organic solvents and adding and stirring two or more different sizes of silver particles to produce the silver paste. The silver paste can be applied as a thin coating between first and second silver-coated surfaces, dried, and sintered to form a high-strength sintered joint. For example, the high-strength sintered joint can be used for die attaching applications. The method improves the reliability of power module packaging and allows the power density of the power electronics in electric vehicles to be increased in a cost-effective manner.

Figure 1:
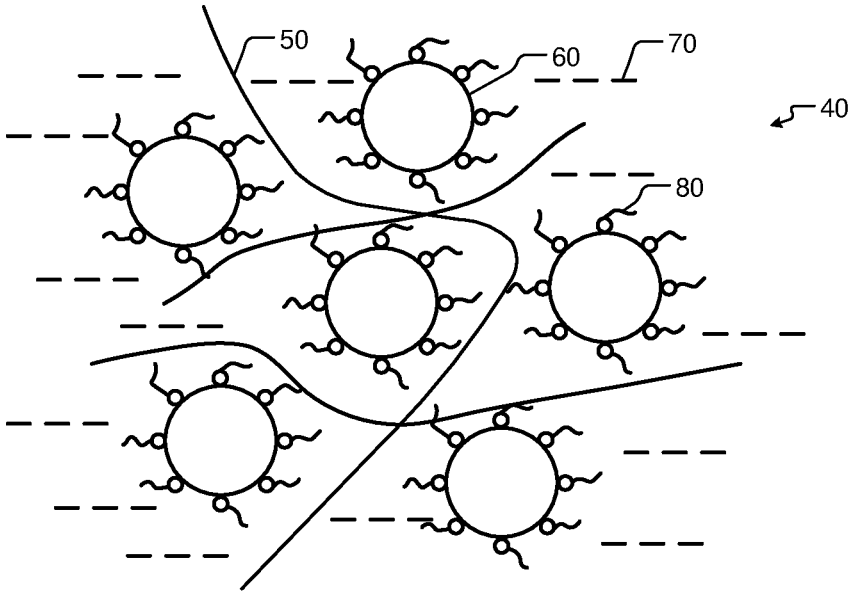
FIG. 1 illustrates an example of a composition of a sinterable silver paste.

Referring now to FIG. 1, a sinterable silver paste 40 includes a binder 50, silver particles 60, a thinner 70, and a dispersant 80. A method for preparing the sinterable silver paste 40 includes water bath heating (e.g., using ethanol), adding an organic composition and stirring, adding silver particles, performing ultrasonic dispersion, and stirring for a predetermined period in a range from 1 to 2 hours, and vacuum volatilizing excess ethanol for a second predetermined period in a range from 3 to 5 hours. However, this method is time consuming and uses large quantities of ethanol.

Figure 2:
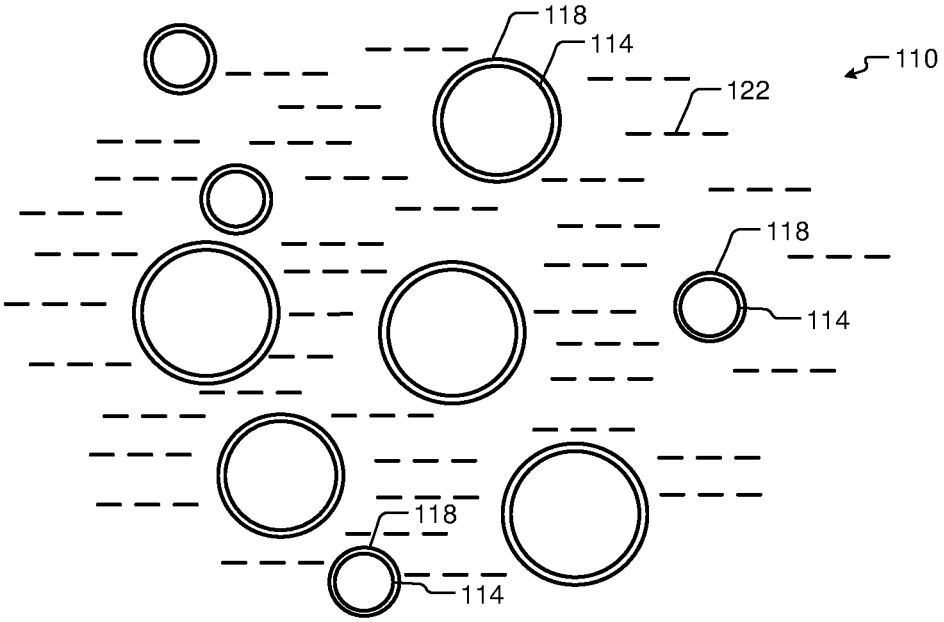
FIG. 2 illustrates an example of a composition of a sinterable silver paste according to the present disclosure.

Referring now to FIG. 2, a sinterable silver paste 110 according to the present disclosure includes a mixture of silver particles 114 having a coating 118 (e.g., sodium citrate), and organic solvents 122. The method according to the present disclosure reduces the number of steps from 5 to 3. The method for preparing silver paste according to the present disclosure includes three steps that involve mixing and stirring. More particularly, organic solvents are ultrasonically mixed for a first predetermined period (e.g., 5 to 15 minutes), silver particles are added to the mixture, and the mixture with the silver particles is stirred for a second predetermined period (e.g., 5 to 15 minutes). The silver paste can be used in the sintering process or stored for later use.

The method for preparing silver paste according to the present disclosure reduces the use of ethanol and eliminates the water bath heating used in the prior process. The method according to the present disclosure also reduces the ultrasonic dispersion period and eliminates vacuum evaporation in the prior processes. Preparation time is significantly reduced from more than 3 hours to less than or equal to 30 minutes.

Figure 3:
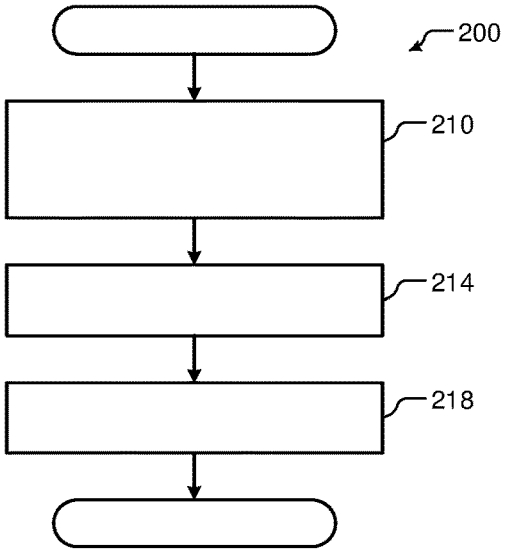
FIG. 3 is a flowchart of a method for preparing the silver paste according to the present disclosure.

Referring now to FIG. 3, a method 200 for preparing silver paste is shown. At 210, organic solvents are ultrasonically mixed for a first predetermined period. In some examples, the first predetermined period is in a range from 5 to 15 minutes. At 214, silver particles are added to the mixture. In some examples, the silver particles have two or more particle sizes.

At 218, the mixture is stirred for a second predetermined period. In some examples, the second predetermined period is in a range from 5 to 15 minutes. In some examples, the silver paste is packaged and stored at a predetermined storage temperature until usage. In some examples, the predetermined storage temperature is in a range from 0° C. to 5° C.

In some examples, the organic solvents comprise a mixture of succinic acid, 1-butoxy-2-propanol, terpineol, ethanol and ethylene glycol. In some examples, succinic acid comprises 0.05% to 0.2% wt. (e.g., 0.12% wt.). In some examples, 1-butoxy-2-propanol comprises 2% to 5% wt. (e.g., 3% wt.). In some examples, terpineol comprises 3% to 8% wt. (e.g., 4.52% wt.). In some examples, ethanol comprises 3% to 8% wt. (e.g., 4.87% wt.). In some examples, ethylene glycol comprises 8 to 12% wt. (e.g., 9.72% wt.). In some examples, the silver particles comprise 75 to 90% wt. (e.g., 77.77% wt.).

In some examples, the silver paste includes silver particles having two or more particle sizes where the second particle size is more than twice the first particle size. In some examples, the first particle size is in a range from 50 nm to 150 nm and the second particle size is in a range from 300 nm to 600 nm. In some examples, the first particle size is in a range from 50 nm to 90 nm (e.g., 70 nm) and the second particle size is in a range from 300 nm to 600 nm (e.g., 500 nm). In some examples, a mass ratio of the first particle size to the second particle size is 5:1 to 1:3 (e.g., 3:1).

In some examples, the silver particles are coated with sodium citrate. In some examples, the sodium citrate coating has a thickness in a range from 0.1 nm to 5 nm (e.g., 1 nm).

Figure 4:
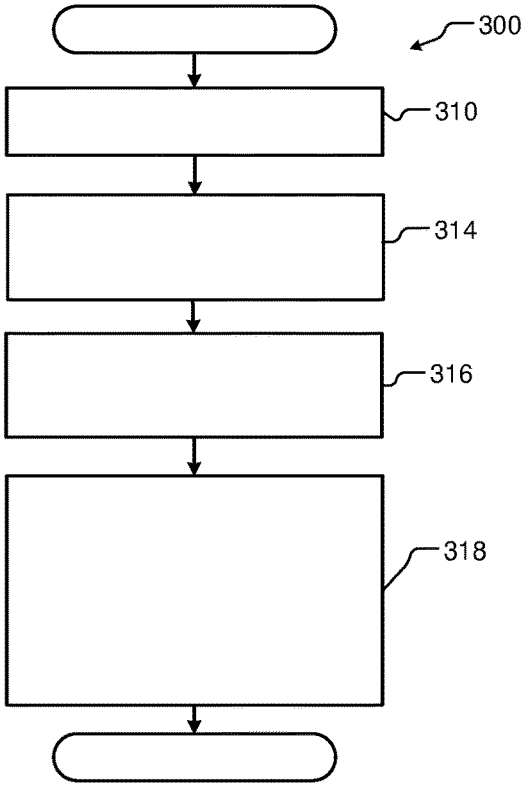
FIG. 4 is a flowchart of a method for sintering the silver paste to create a joint according to the present disclosure.

Referring now to FIG. 4, a method for sintering the silver paste to create a sintered joint is shown. At 310, the silver paste is applied to a first component such as a silver-plated surface of a substrate. In some examples, the silver paste is applied at a thickness in a range from 20 μm to 200 μm (e.g., 100 μm). At 314, the first component and silver paste are baked for a predetermined baking period in a range from 5 to 40 minutes (e.g., 20 minutes) and a predetermined temperature in a range from 50° C. to 90° C. (e.g., 70° C.). At 316, a second component such as a silver-plated surface of a substrate is arranged on the silver paste and the first component with the silver paste sandwiched therebetween.

At 318, the first component, the second component and the silver paste are pressure sintered at a pressure in a pressure range from 1 to 10 MPa (e.g., 5 MPa) and a temperature in a predetermined temperature range from 250° C. to 280° C. (e.g., 280° C.) for a predetermined period in a range from 3 to 10 minutes (e.g., 5 minutes). In some examples, the shear strength of the sintered joint is in a range of 10 MPa to 60 MPa (e.g., 40 MPa).

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information, but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

What is claimed is:

1. A method for preparing a silver paste, comprising:

creating a mixture of succinic acid, 1-butoxy-2-propanol, terpineol, ethanol, and ethylene glycol;

ultrasonically mixing the mixture for a first predetermined period;

adding silver particles; and mechanically stirring the mixture for a second predetermined period to create the silver paste.

2. The method of claim 1, wherein the first predetermined period is in a range from 5 to 15 minutes.

3. The method of claim 1, wherein the second predetermined period is in a range from 5 to 15 minutes.

4. The method of claim 1, wherein ultrasonically mixing the mixture is performed at room temperature.

5. The method of claim 1, wherein:

the succinic acid is in a range from 0.05% to 0.2% wt., the 1-butoxy-2-propanol is in a range from 2% to 5% wt., the terpineol is in a range from 3% to 8% wt., the ethanol is in a range from 3% to 8% wt.;

the ethylene glycol is in a range from 8 to 12% wt.; and the silver particles are in a range from 75 to 90% wt.

6. The method of claim 1, wherein the silver particles include:

first particles having a size in a range from 50 nm to 150 nm; and second particles having a size in a range from 300 nm to 600 nm.

7. The method of claim 6, wherein a mass ratio of the first particles to the second particles is in between 5:1 and 1:3.

* * * * *